United States Patent [19]

Suzuki et al.

[11] Patent Number: 5,019,550

[45] **Date of Patent: * May 28, 1991**

[54] SUBLIMATION TYPE THERMOSENSITIVE IMAGE TRANSFER RECORDING MEDIUM, AND THERMOSENSITIVE RECORDING METHOD USING THE SAME

[75] Inventors: Akira Suzuki, Mishima; Hidehiro Mochizuki, Numazu; Masaru Shimada, Shizuoka; Hiroyuki Uemura, Numazu, all of Japan

[73] Assignee: Ricoh Company, Ltd., Tokyo, Japan

[ * ] Notice: The portion of the term of this patent subsequent to Nov. 14, 2006 has been disclaimed.

[21] Appl. No.: 379,099

[22] Filed: Jul. 13, 1989

[30] Foreign Application Priority Data

| | | | |
|---|---|---|---|
| Jul. 15, 1988 | [JP] | Japan | 63-175147 |
| Jul. 15, 1988 | [JP] | Japan | 63-175148 |
| Nov. 8, 1988 | [JP] | Japan | 63-201420 |

[51] Int. Cl.[5] ..... B41M 5/035; B41M 5/26

[52] U.S. Cl. ..... 503/227; 8/471; 428/195; 428/212; 428/484; 428/913; 428/914

[58] Field of Search ..... 8/471; 428/195, 913, 428/914, 212, 484; 503/227

[56] References Cited

U.S. PATENT DOCUMENTS 4,720,480 1/1988 Ito et al. ..... 503/227

FOREIGN PATENT DOCUMENTS 0192435 8/1986 European Pat. Off. ..... 503/227

*Primary Examiner*—Bruce H. Hess

*Attorney, Agent, or Firm*—Oblon, Spivak, McClelland, Maier & Neustadt, P.C.

[57] ABSTRACT

A sublimation type thermosensitive image transfer recording medium comprising a support; a dye supplying layer formed on the support, comprising a sublimable dye and an organic binder agent in which the sublimable dye is dispersed; and an image transfer facilitating layer formed on the dye supplying layer, comprising said sublimable dye, an organic binder agent in which said sublimable dye is dispersed, and a lubricant or releasing material having lubricant or releasing properties, which is dispersed in the image transfer facilitating layer or present on the surface of said image transfer facilitating layer, and a thermosensitive image transfer recording process using the sublimation type thermosensitive image transfer recording medium are disclosed.

25 Claims, 6 Drawing Sheets

SUBLIMATION TYPE THERMOSENSITIVE IMAGE TRANSFER RECORDING MEDIUM, AND THERMOSENSITIVE RECORDING METHOD USING THE SAME

BACKGROUND OF THE INVENTION

1. Field of the Invention

The present invention relates to a sublimation type thermosensitive image transfer recording medium, and a thermosensitive recording method using the thermosensitive image transfer recording medium.

2. Discussion of Background

Recently a demand for full color printers is increasing year by year. Representative recording methods for full color printers now available include an electrophotographic method, an ink-jet method, and a thermosensitive image transfer method. Of these methods, the thermosensitive image transfer method is most widely employed because of its advantages over the other methods in that maintenance is easy and operation is noiseless.

In the thermosensitive image transfer recording method, a solidified color ink sheet and a receiving sheet are employed, and the color ink is transferred imagewise from the ink sheet to the receiving sheet due to the thermal fusion of the ink or the sublimation of the ink, under the application of thermal energy by laser beams or a thermal head which is controlled by electric signals.

Thus, the thermosensitive image transfer recording method can be roughly classified into two types, a thermal fusing image transfer type and a sublimation image transfer type. The sublimation image transfer type is advantageous over the thermal fusing type in that halftone can be obtained without difficulty and image gradation can be controlled as desired. These benefits exist because a sublimable dye is in principle sublimated in the form of independent molecules in such an amount as to correspond to the amount of thermal energy applied thereto, for instance, through a thermal head. Therefore, the sublimation image transfer type is considered the most suitable for color printers.

The sublimation image transfer recording method, however, has a shortcoming in that its running cost is high, because in this image transfer method, a yellow ink sheet, a magenta ink sheet, a cyan ink sheet and when necessary, a black ink sheet, have to be employed in order to obtain a full-color image, with selective application of thermal energy to each ink sheet, and discarded after the recording, even though large unused portions remain on each ink sheet.

In order to eliminate this shortcoming, the following proposals have been made: (1) an equal speed mode in which an ink sheet and a receiving sheet are moved at the same speed for using the ink sheet in repetition and (2) an N-times use mode in which the running speed of the ink sheet is made lower than that of the receiving sheet so that the overlappingly used portions of the ink sheet at the first use and the second use are shifted little by little.

In the sublimation type thermosensitive image transfer recording method, the sublimation and evaporation reaction is fundamentally a reaction of zero order. Therefore, in the equal speed mode, the ink sheet cannot be used multiple times for printing because the printed image density significantly decreases as the number of printings increases, particularly in high image density areas, even though a sufficient amount of a dye for multiple printing is contained in the ink layer of the ink sheet.

In order to improve the drastic decrease in transferred image density during multiple printing, the present inventors proposed a sublimation type thermosensitive image transfer recording medium comprising a dye supplying layer and an image transfer facilitating layer in Japanese Laid-Open Patent Application 63-62866. In this recording medium, the sublimable dye discharging performance of the dye supplying layer is made greater than that of image transfer facilitating layer.

In the above recording medium, however, only a small amount of a binder resin is generally incorporated into the dye supplying layer in order to make the concentration of the dye relatively high or in order to increase the diffusion coefficient of the dye. This brings about low adhesion between the dye supplying layer and a substrate, and, as a result, the ink layer transfers in its entirety to an image receiving layer (exfoliation of the ink layer) depending on the recording conditions, for example, when high voltage is impressed.

Furthermore, when the multiple printing is conducted in the N-times use mode, an ink layer and an image receiving layer adhere to each other or friction is caused therebetween, so that improper running of the ink sheet tends to take place.

SUMMARY OF THE INVENTION

It is therefore an object of the present invention to provide a sublimation type thermosensitive image transfer recording medium, which does not cause drastic decrease in transferred image density even when it is used repeatedly, is free from exfoliation of an ink layer and the adhesion to a thermal head, and does not bring about improper running of the recording medium.

Another object of the present invention is to provide a thermosensitive recording method using the above sublimation type thermosensitive image transfer recording medium, which can overcome the drawbacks in the conventional printing method of the N-time use mode.

The first object of the present invention is attained by a sublimation type thermosensitive image transfer recording medium comprising (1) a support, (2) a dye supplying layer formed on the support, comprising a sublimable dye and an organic binder agent in which the sublimable dye is dissolved or dispersed, and (3) an image transfer facilitating layer formed on the dye supplying layer, comprising the sublimable dye, an organic binder agent in which the sublimable dye is dissolved or dispersed, and a lubricant or releasing material having lubricant releasing properties which is dispersed in the image transfer facilitating layer or placed on the surface of the layer either in the form of a releasing layer or in a scattered form. The image transfer facilitating layer facilitates the diffusion of the sublimable dye contained in the dye supplying layer from its free surface thereof to a receiving sheet for thermosensitive image transfer printing, thereby facilitating the image transfer.

The second object of the present invention is attained by a thermosensitive recording method comprising the steps of superimposing the above sublimation type thermosensitive image transfer recording medium on a receiving sheet, and applying heat imagewise to the sublimation type thermosensitive image transfer recording medium so as to imagewise transfer the sublimable dye from the recording medium to the receiving sheet by a heat application recording means as the recording medium and the receiving sheet are moved at an equal speed or moved in such a manner that the running speed of the recording medium is smaller than that of the receiving sheet.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Referring now to the accompaning drawings, the present invention will be explained in more detail.

Figure 1:
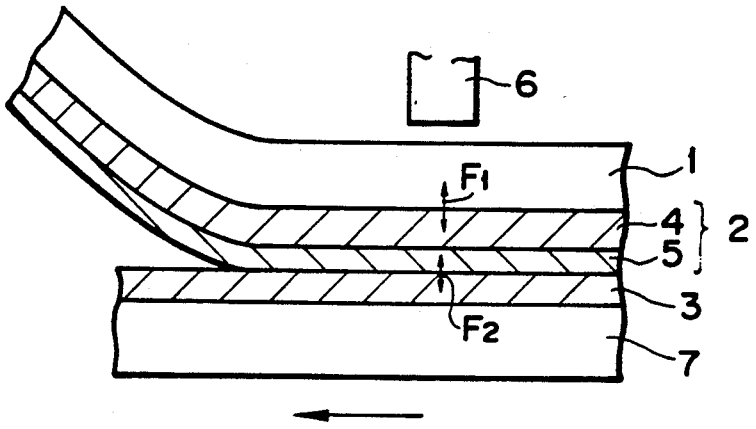
FIG. 1 is a schematic illustration in explanation of the structure of a sublimation type thermosensitive image transfer recording medium according to the present invention.

FIG. 1 is a schematic illustration of the structure of a sublimation type thermosensitive image transfer recording medium of the present invention, in which a support is indicated by reference numeral 1, an ink layer formed on the support 1 is indicated by reference numeral 2, a dye supplying layer contained in the ink layer 2 formed on the support 1 is indicated by reference numeral 4, an image transfer facilitating layer contained in the ink layer 2 formed on the dye supplying layer 4 is indicated by reference numeral 5, an image receiving layer is indicated by reference numeral 3, and a support for the image receiving layer 3 is indicated by reference numeral 7.

In this recording medium, when $F_1$ indicates the adhesion force between the dye supplying layer 4 and the support 1, and $F_2$ indicates the adhesion force between the image transfer facilitating layer 5 and the image receiving layer 3, the relationship between adhesion force $F_1$ and adhesion force $F_2$ is made $F_1 > F_2$ in order to overcome the shortcomings in the conventional thermosensitive image transfer recording medium in which the relationship between $F_1$ and $F_2$ is $F_1 < F_2$ The above relationship between two adhesion forces $F_1$ and $F_2$ can be attained by decreasing adhesion force $F_2$ or increasing adhesion force $F_1$.

Adhesion force $F_1$ can readily increased, for example, by employing a resin which is used for the support as at least one of the binder agents to be employed in the dye supplying layer formed on the support, by using the support made of substantially the same resin as that employed in the dye supplying layer.

Adhesion force $F_2$ can be decreased by dispersing a lubricant or releasing material having releasing properties in the image transfer facilitating layer or forming a releasing layer containing the lubricant or releasing material on the surface thereof or distributing the material on the surface thereof.

Examples of the lubricant or releasing materials include petroleum lubricating oils such as liquid paraffin; synthetic lubricating oils such as diester oil, silicone oil and fluorine-containing silicone oil, modified silicone oils such as epoxy-modified silicone oil, amino-modified silicone oil, alkyl-modified silicone oil and polyether-modified silicone oil; silicone lubricating materials such as a copolymer of silicone and an organic compound, for example, polyoxyalkylene glycol; fluorine-containing surface active agents such as a fluoroalkyl compound; fluorine-containing lubricating materials such as a low-molecular weight polymer of chloroethylene trifluoride, waxes such as paraffin wax and polyethylene wax; and other materials such as higher fatty acids, higher aliphatic alcohols, higher aliphatic amides, higher aliphatic esters, and salts of higher fatty acids.

These lubricant or releasing materials can be used in the form of particles.

It is preferable to disperse the lubricant or releasing material in the image transfer facilitating layer in an amount of 5 to 30 wt.% of the entire weight of the image transfer facilitating layer in order to obtain preferable releasing properties, recording sensitivity and preservability of the recording medium.

In the case where the releasing layer is formed on the surface of the image transfer facilitating layer, the above lubricant or releasing materials may be directly coated onto the surface of the image transfer facilitating layer. It is however preferable to disperse or dissolve the lubricant or releasing materials in a heat-resistant resin serving as a binder, and to coat the resulting liquid onto the surface of the image transfer facilitaing layer.

As the heat-resistant resin serving as a binder, any resins which are thermally resistant, and have a glass transition temperature of 100° C. or more and a melting or softening point of 200° C. or more can be employed. Examples of such heat-resistant resins include thermosetting resins such as epoxy resin, silicone resin, xylene resin, urea resin, melamine resin, unsaturated polyester resin, alkyd resin and furan resin; and thermoplastic resins having relatively high heat resistance such as acetylcellulose, acetylbutylcellulose, polysulfone, polycarbonate, polystyrene and acryl resin. The above heat-resistant resins which are hardened with a hardening agent or cross-linking agent under application of heat or ultraviolet rays may also be employed as the binder.

As a preferable releasing agent for use in the releasing layer, a silicone resin having the following formula is employed:

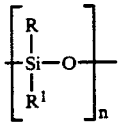

wherein R and $R^1$ each represent a methyl group or a phenyl group.

In addition to the above silicone resin, various modified silicone resins such as alkyd-modified silicone resin, epoxy-modified silicone resin and acryl-modified silicone resin, and silicone-modified resins such as silicone-modified acryl resin and silicone-modified acrylurethane resin can be employed. It is however preferable to harden or cross-link the above modified resins by using a hardening agent or a cross-linking agent when they are employed.

The releasing layer may further contain inorganic powders such as silica, $TiO_2$ and calcium carbonate, and organic powders such as cellulose.

A preferred thickness of the releasing layer is 2 μm or less, and a more preferred range of the thickness is 0.05 to 1 μm when image density and releasing effects are taken into consideration.

In the present invention, the dye supplying layer and the image transfer facilitating layer are structured in such a manner that when the dye supplying layer and the image transfer facilitating layer are separately formed on a support, and they are separately superimposed on the same receiving sheet, and the same quantity of thermal energy is applied thereto, the amount (weight/unit time·unit area) of the sublimable dye transferred from the dye supplying layer to the receiving sheet is greater than the amount (weight/unit time·unit area) of the sublimable dye transferred from the image transfer facilitating layer to the receiving sheet.

In the present invention, thermal image transfer may be carried out by use of a thermal head, by laser beams, using a support which absorb laser beams and generates heat therefrom, or by causing an electric current to flow through the support and/or an ink-containing layer formed thereon so as to generate Joule's heat therein, which is referred to as the electrothermic non-impact printing.

In the thermosensitive recording method according to the present invention, heat is applied imagewise to the above-described sublimation type thermosensitive image transfer recording medium, and the sublimation type dye transfers imagewise from the recording medium to the receiving sheet. While the above process is going on, the running speed of the recording medium is made equal to or lower than that of the receiving sheet.

In the present invention, Fick's law can be applied to the diffusion of a dye contained in the dye supplying layer and the image transfer facilitating layer which constitute an ink layer. More specifically, the amount (dn) of the dye which passes through the sectional area (q) of the ink layer for a period of time (dt) is represented by the following equation:

$$dn = -\overline{D}(dc/dx)zdt$$

where dc/dx is the dye concentration gradient in the direction of the diffusion of the dye, and D is the average diffusion coefficient in each section of the ink layer.

In order to facilitate the diffusion of a sublimable dye from the dye supplying layer to the image transfer facilitating layer, the following two methods are available:

(1) The concentration of the dye in the dye supplying layer is made greater than that of the dye in the image transfer facilitating layer.

(2) The diffusio coefficient of the dye in the dye supplying layer is made greater than that of the dye in the image transfer facilitating layer.

Specific means for carrying out the second method are described, for example, in "Fiber Association Journal" (Sen'i Gakkaishi) Vol. 30, No. 12 (974) by Toyoko Sakai et al; "Dyeing Theoretical Chemistry" by Norihiko Kuroki (published by Maki Shoten) page 503; and "First Non-impact Printing Technologies Symposium Papers" No. 3 to No. 5.

With reference to the above articles, more specific methods for carrying out the second method are as follows:

(a) A method of using as the organic binder agent in the image transfer facilitating layer an organic polymeric material having more proton-donating groups or proton-accepting groups, with which sublimable dyes may easily form hydrogen bonds therebetween, as compared with an organic binder agent, since the diffusion coefficient of a dye is effected by an energy control effect on the diffusion of the dye, such as the hydrogen bond between the dyes and organic binder agents. In other words, in this method, in the image transfer facilitating layer, an organic binder agent having a greater capability of bonding with the sublimation dye than the capability of the organic binder agent of bonding with the sublimation dye in the dye supplying layer is employed.

(b) A method of using an organic binder agent in the dye supplying layer, which has a lower glass transition temperature or a lower softening point than the glass transition or softening point of an organic binder agent contained in the image transfer facilitating layer, since the diffusion coefficient of the dye depends upon the glass transition temperature or the softening point of the organic binder agent in which the dye is dispersed.

(c) A method of containing a plasticizer in the dye supplying layer, which is compatible with at least one organic binder agent in the dye supplying layer, and not compatible with any of organic binder agents contained in the image transfer facilitating layer.

(d) A method of using any or all of the above-mentioned methods (a), (b) and (c) in combination.

As a matter of course, any other methods capable of satisfying the above-mentioned relationship concerning the diffusion coefficient can be employed.

When designing the formulations of the dye supplying layer and the image transfer facilitating layer for use in the present invention, the above-mentioned methods (1) and (2) are useful. Whether or not the desired effect is attained by any of the above methods can be easily confirmed by separately forming the dye supplying layer and the image transfer facilitating layer on a substrate, with an equal deposition amount of the components of each layer with each formulation, superimposing each of the dye supplying layer and the image transfer layer on a receiving sheet, and applying an equal amount of thermal energy thereto for sublimation of the dyes from the two layers onto the receiving sheet, to confirm the relationship that the amount (weight/unit time·unit area) of the sublimable dye transferred from the dye supplying layer to the receiving sheet is greater than the amount (weight/unit time·unit area) of the sublimable dye transferred from the image transfer facilitating layer to the receiving sheet.

The dye supplying layer has a thickness, preferably in the range of 0.1 μm to 20 μm, more preferably in the range of 0.5 μm to 5 μm, while the image transfer facilitating layer has a thickness, preferably in the range of 0.05 μm to 5 μm, more preferably in the range of 0.1 μm to 2 μm.

The sublimable dyes which can be used in the dye supplying layer and the image transfer facilitating layer are those employed conventionally, which are volatilized or sublimed at 60° C. or above, specifically those employed in thermal transfer printing, for example, disperse dyes and oil-soluble dyes. Specific examples of such dyes are C.I. Disperse Yellow 1, 3, 8, 9, 16, 41, 54, 60, 77 and 116; C.I. Disperse Red 1, 4, 6, 11, 15, 17, 55, 59, 60, 73 and 83; C.I. Disperse Blue 3, 14, 19, 26, 56, 60, 64, 72, 99 and 108; C.I. Solvent Yellow 77 and 116; C.I. Solvent Red 23, 25 and 27; and Solvent Blue 36, 83 and 105. These dyes can be used alone or in combination.

The binder agents which can be used in the dye supplying layer and the image transfer facilitating layer are thermoplastic resins and thermosetting resins. Of those resins, examples of the resins having relatively high glass transition points or relatively high softening points are vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-contained resin, butyral resin, melamine resin, natural rubber, synthetic rubber, polyvinyl alcohol, and cellulose resins. These resins can be used alone or in combination, or in the form of copolymers.

In order to make the dye supplying layer and the image transfer facilitating layer different in terms of the glass transition temperature or softening point thereof, resins, and natural or synthetic rubbers having glass transition temperatures of 0° C. or less, or softening points of 60° C. or less may be employed for the dye supplying layer.

Specific examples of such resins, natural rubbers and synthetic rubbers are as follows:

Syndiotactic 1,2-polybutadiene (commercially available from Japan Synthetic Rubber Co., Ltd. under the trademarks of JSR RB810, 820, and 830), acidic or non-acidic acid containing olefin copolymers and terpolymers (commercially available from Dexon Chemical Co., Ltd. under the trademarks of Dexson XEA-7), ethylene-vinyl acetate copolymer (commercially available from Allied Fibers & Plastics under the trademarks of 400 & 400A, 405, 430; and from Du Pont-Mitsui Polychemicals Co., Ltd. under the trademarks of P-3307 (EV150) and P-2807(EV250)); low-molecular weight polyolefin polyol and derviatives thereof (commercially available from Mitsubishi Chemical Industries, Ltd. under the trademarks of Polytail H, and HE); brominated epoxy resins (commercially available from Toto Chemical Co., Ltd. under the trademarks of YDB-340, 400, 500, 600); novolak type epoxy resin (commercially available from Toto Chemical Co., Ltd. under the trademarks of YDCN-701, 702, 703); thermoplastic acryl solutions (commercially available from Mitsubishi Rayon Engineering Co., Ltd. under the trademarks of Dianal LR1075, 1080, 1081, 1082, 1063, and 1079); thermoplastic acryl emulsions (commercially available from Mitsubishi Rayon Engineering Co., Ltd. under the trademarks of LX-400 and LX-450); polyethylene oxide (commercially available from Meisei Chemical Works, Ltd. under the trademarks of Alkox E-30, 45, Alkox R-150, 400, 1000); caprolactone polyol (commercially available from Daicel Chemical Industries, Ltd. under the trademarks of Placcel H-1, 4, 7). In particular, polyethylene oxide and polycaprolactone polyol are preferable for use in practice. It is also preferable that these resins be used in combination with the previously mentioned one or more thermoplastic or thermosetting resins.

The concentration of the sublimable dye contained in the image transfer facilitating layer is preferably in the range of 5 wt.% to 80 wt.%, more preferably in the range of about 10 wt.% to 60 wt.%, while the concentration of the sublimable dye contained in the dye supplying layer is preferably in the range of 5 wt.% to 80 wt.%. In order to make a dye concentration gradient between the image transfer facilitating layer and the dye supplying layer, the dye concentration in the dye supplying layer is preferably 1.1 to 5 times, more preferably 1.5 to 3 times, the dye concentration in the image transfer facilitating layer.

In the dye supplying layer, fillers may be contained. Examples of the fillers are finely-divided inorganic and organic particles.

Specific examples of such finely-divided particles are finely-divided inorganic particles of metal oxides such as zinc oxide, tin oxide and aluminum oxide, finely-divided particles of metals such as aluminum, copper and cobalt (occasionally these can be employed in the form of foil), finely-divided organic particles of diatomaceous earth, Molecular Sieves, phenolic resin, epoxy resin, carbon black. The above can be used alone or in combination.

All of the above finely-divided particles have good coagulation performance. Of the above particles, carbon black is particularly preferable for use in the present invention since it is excellent in coagulation performance. Carbon black is usually used as black pigment. In the present invention, however, it works as a medium from which the ink components seep out when the viscosity thereof is reduced upon application of heat thereto. Therefore, carbon black is not transferred together with the ink components to the receiving sheet, but remains in the image transfer recording medium.

It is preferable that the amount of such fillers be 10 to 80 wt.%, more preferably 30 to 60 wt.%, to the entire weight of the ink compositions in the dye supplying layer. When the above finely-divided particles are employed, they form a stone-wall-like structure, but no special coating method is required to form the stone-wall-like structure.

Instead of the above-mentioned fillers, needle-like pigments, not only inorganic pigments, but also organic pigments, can be employed as long as they are in the form of needles and can constitute a network in the dye supplying layer.

Specific examples of such needle pigments are ochre, Chrome Yellow G, Phthalocyanine pigments such as Phthalocyanine Blue, Lithol Red, BON Maroon Light, terra abla, needle zinc oxide, 2,7-bis[2-hydroxy-3-(2-chlorophenylcarbamoyl)naphthalene-1-ylazo]-9-fluorenone, 4',4''-bis[2-hydroxy-3-(2,4-dimethylphenyl)carbamoylnaphthalene-1-ylazo]-1,4-distyrylbenezene.

It is preferable that such needle-like pigments be 0.3 to 3 μm long and not more than 0.5 μm wide and thick. Further, it is preferable that the amount of the above needle-like pigments be 0.5 to 10 parts by weight, more preferably 1 to 5 parts by weight, to 1 part by weight of the dye.

The materials for the support of the recording medium according to the present invention are, for example, films such as condenser paper, polyester film, polystyrene film, polysulfone film, polyimide film, and polyaminde film. When the polyamide film is used for the support, the support can be backed by a heat-resistant-releasing layer containing as its main component a polysiloxane grafted polymer in order to reinforce the support. Such a backing layer is formed on the back side of the support, opposite to the surface on which the dye supplying layer is formed.

A conventionally employed adhesive layer may be interposed between the support made of any of the above sheets and the dye supplying layer, and a conventionally employed heat-resistant lubrication layer may be formed on the back side of the support opposite to the dye supplying layer.

The plasticizers to be contained in the dye supplying layer, previously mentioned in the practice (c) in the method (2) are defined as such materials that come between molecules of a resin and reduce the van der Waals' forces between the molecules by which the hard network structure of the resin is formed, and consequently decreasing the second order transition temperature of the resin. Further the term "compatibility" is defined as both the plasticizer and the resin having affinity for each other, with high gelation rate, and the plasticizer not being separated from the resin.

Plasticizers and resins for use in the present invention can be selected as desired, with the compatibility thereof taken into consideration, from various publications, catalogs and references, for example, "Plastic Ingredients", page 17–, by Sakura Yamada, published by Taiseisha Co., Ltd. and "Chemical Products of 1988", page 745–, published by Kagaku Kogyo Niopposha, Co., Ltd.

Specific examples of combinations of plasticizers, compatible resins, and non-compatible resins are as follows, in which plasticizers and compatible resins are used in the dye supplying layer, while non-compatible resins are employed in the image transfer facilitating layer.

| Plasticiers | Compatible Resins | Non-compatible Resins |
|---|---|---|
| Tricresyl phosphate | Acetylcellulose<br>Acetylbutylcellulose<br>Ethylcellluose<br>Acrylic resin<br>Acetylbutyl resin<br>Butyral resin | Polyvinylidene chloride<br>Polyamide |
| Tri-2-ethyl hexyl-phosphate | Nitrocellulose<br>Ethylcellulose<br>Butyral resin<br>Vinyl chloride resin | Acetylcellulose<br>Acetylbutylcellulose<br>Vinyl acetate resin |
| Triphenyl phosphate | Acetylcellulose<br>Ethylcellulose<br>Vinyl acetate resin | Butyral resin<br>Polyamide |
| Di-2-ethyl hexyl-phthalate | Acetylbutylcellulose<br>Ethylcellulose<br>Bytyral resin<br>Vinyl chloride resin<br>Nitrocellulose | Acetylcellulose<br>Vinyl acetate resin<br>Polyamide |
| Diisodecyl phthalate | Acetylbutylcellulose<br>Nitrocellulose<br>Ethylcellluose<br>Butyral resin | Acetylcellulose<br>Polyvinyl acetate |
| Ditridecyl hexyl-phthalate | Vinyl acetate resin<br>Vinyl chloride resin | Acetylcellulose<br>Acetylbutylcellulose<br>Ethylcellulose<br>Butyral resin |

The above listed plasticizers are particularly preferable for use in the present invention because they are excellent in heat resistance and volatility.

The ratio of the added amount of the plasticizers to the amount of the resins is preferably 10 to 100 wt.%, more preferably 10 to 50 wt.%.

In the recording medium explained so far, the dye layer is divided into two layers, that is, the dye supplying layer and the image transfer facilitating layer. The dye layer can be into more than two layers as long as the separated functions intended in the present invention are attained, with appropriate differences in the amount of the dyes transferred therebetween.

In the present invention, thermal image transfer may be carried out by use of a thermal head, by laser beams, using a support which absorb laser beams and generates heat therefrom, or by causing an electric current to flow through the support and/or an ink-containing layer formed thereon so as to generate Joule's heat therein, that is, by the so-called electrothermic non-impact printing. The electrothermic non-impact printing method is described in many references, such as U.S. Pat. No. 4,103,066, Japanese Laid-Open Patent Applications 57-14060, 57-11080 and 59-9096.

When the electrothermic non-impact printing method is employed, as the support for the thermosensitive image transfer recording medium according to the present invention, supports which are modified to have an intermediate electric resistivity between electroconductive materials and insulating materials, for example, by dispersing finely-divided electroconductive particles, such as finely-divided metal particles of aluminum, copper, iron, tin, zinc, nickel, molybudenum, and silver, and/or carbon black, in a resin having relatively good heat resistance, such as polyester, polycarbonate, triacetylcellulose, nylon, polyimide, and aromatic polyamides, or by using a support of the above-mentioned resins, with the above-mentioned electroconductive metals deposited thereon by vacuum deposition or sputtering.

It is preferable that the thickness of such supports be in the range of about 2 μm to about 15 μm, when the thermal conductivity thereof for the generated Joule's heat is taken into consideration.

As mentioned above, when laser beams are employed for image transfer, it is preferable that the support absorb laser beams and generates heat. For this purpose, for example, a support comprising a conventional thermal transfer film with addition thereto a material which absorbs heat and convert the light into heat, such as carbon black, may be employed. Alternatively, a light-absorbing and heat-generating layer may be laminated on the front and/or back side of the support.

The features of this invention will become apparent in the course of the following description of exemplary embodiments which are given for illustration of the invention and are not intended to be limiting thereof.

EXAMPLE 1—1

Preparation of Dye Supplying Layer

A mixture of the following components was dispersed in a ball mill for 24 hours, whereby a dye supplying layer coating dispersion No. 1—1 was prepared:

| | Parts by Weight |
|---|---|
| Polyvinyl butyral resin (Trademark "BX-1" made by Sekisui Chemical Co., Ltd.) | 10 |
| Sublimable dye (Trademark "Kayaset Blue 714" made by Nippon Kayaku Co., Ltd.) | 20 |
| Solvents: Toluene | 100 |
| Methyl ethyl ketone | 100 |

Preparation of Image Transfer Facilitating Layer

A mixture of the following components was dispersed in a ball mill for 24 hours, whereby an image transfer facilitating layer coating dispersion No. 1—1 was prepared:

| | Parts by Weight |
|---|---|
| Polyvinyl butyral resin (Trademark "BX-1" made by Sekisui Chemical Co., Ltd.) | 10 |
| Sublimable dye (Trademark "Kayaset Blue 714" made by Nippon Kayaku Co., Ltd.) | 10 |
| Silicone oil serving as lubricant (Trademark "SF8417" made by Toray Silicone Co., Ltd.) | 2 |
| Solvents: Toluene | 100 |
| Methyl ethyl ketone | 100 |

The dye supplying layer coating dispersion No. 1—1 was coated by a wire bar on a polyimide film having a thickness of 8.5 μm (made by Toray-DuPont Co., Ltd.) serving as a support 1 as illustrated in FIG. 1, whereby a dye supplying layer 4 having a thickness of 2.40 μm when dried was formed on the support 1. Subsequently, the image transfer facilitating layer coating dispersion No. 1—1 was coated by a wire bar on the dye supplying layer 4 and dried, whereby an image transfer facilitating layer 5 having a thickness of 0.61 μm when dried was formed on the dye supplying layer 4, thus a sublimation type thermosensitive image transfer recording medium No. 1—1 according to the present invention was prepared. In this recording medium, the dye supplying layer 4 and the image transfer facilitating layer 5 constitute a thermally transferable ink layer 2 as illustrated in FIG. 1.

EXAMPLE 1—2

Preparation of Dye Supplying Layer

A mixture of the following components was dispersed in a ball mill for 24 hours, whereby a dye supplying layer coating dispersion No. 1—2 was prepared:

| | Parts by Weight |
|---|---|
| Polyvinyl butyral resin (Trademark "BX-1" made by Sekisui Chemical Co., Ltd., having a glass transition temperature of about 83° C.) | 1 |
| Polyethylene oxide (Trademark "Alkox R400" made by Meisei Chemical Works, Ltd., having a glass transition temperature of about −60° C.) | 9 |
| Sublimable dye (Trademark "Kayaset Blue 714" made by Nippon Kayaku Co., Ltd.) | 10 |
| Solvents: Toluene | 100 |
| Methyl ethyl ketone | 100 |

Preparation of Image Transfer Facilitating Layer

A mixture of the following components was dispersed in a ball mill for 24 hours, whereby an image transfer facilitating layer coating dispersion No. 1—2 was prepared:

| | Parts by Weight |
|---|---|
| Polyvinyl butyral resin (Trademark "BX-1" made by Sekisui Chemical Co., Ltd., having a glass transition temperature of about 83° C.) | 10 |
| Sublimable dye (Trademark "Kayaset Blue 714" made by Nippon Kayaku Co., Ltd.) | 10 |
| Paraffin wax (having a melting point of 115° F. made by Nippon Seiro Co., Ltd.) | 3 |
| Solvents: Toluene | 100 |
| Methyl ethyl ketone | 100 |

The dye supplying layer coating dispersion No. 1—2 was coated by a wire bar on a polyimide film having a thickness of 8.5 μm (made by Toray-DuPont Co., Ltd.) serving as a support, whereby a dye supplying layer having a thickness of 2.40 μm when dried was formed on the support. Subsequently, the image transfer facilitating layer coating dispersion No. 1—2 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 1—2 according to the present invention was prepared.

EXAMPLE 1—3

Preparation of Dye Supplying Layer

A mixture of the following components was dispersed in a ball mill for 24 hours, whereby a dye supplying layer coating dispersion No. 1—3 was prepared:

| | Parts by Weight |
|---|---|
| Polyvinyl butyral resin (Trademark "BX-1" made by Sekisui Chemical Co., Ltd., having a glass transition temperature of about 83° C.) | 1 |
| Polycaprolacton (Trademark "Placcel H-7" made by Daicel Chemical Industries, Ltd., having a glass transition temperature of about −60° C.) | 9 |
| Sublimable dye (Trademark "Kayaset Blue 714" made by Nippon Kayaku Co., Ltd.) | 10 |
| Solvents: Toluene | 100 |
| Methyl ethyl ketone | 100 |

The dye supplying layer coating dispersion No. 1—3 was coated by a wire bar on a polyimide film having a thickness of 8.5 μm (made by Toray-DuPont Co., Ltd.) serving as a support, whereby a dye supplying layer having a thickness of 2.40 μm when dried was formed on the support. Subsequently, the image transfer facilitating layer coating dispersion No. 1—3 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 1—3 according to the present invention was prepared.

COMPARATIVE EXAMPLE 1—1

Example 1—1 was repeated except that silicone oil (Trademark "SF 8417") employed in Example 1—1 was eliminated from the image transfer facilitaing layer coating dispersion, whereby a comparative sublimation type thermosensitive image transfer recording medium No. 1—1 was prepared.

COMPARATIVE EXAMPLE 1—2

Example 1—2 was repeated except that paraffin wax having a melting point of 115° F. employed in Example 1—2 was eliminated from the image transfer facilitating layer coating dispersion, whereby a comparative sublimation type thermosensitive image transfer recording medium No. 1—2 was prepared.

COMPARATIVE EXAMPLE 1—3

The image transfer facilitating layer coating dispersion No. 1—1 prepared in Example 1—1 was coated onto a polyimide film having a thickness of 8.5 μm (made by Toray-DuPont Co., Ltd.) by using a wire bar, thereby forming an ink layer having a thickness of 3.01 μm when dried. Thus, a comparative sublimation type thermosensitive image transfer recording medium No. 1—3 having a mono-ink layer 2 was prepared.

EVALUATION 1—1

A dispersion having the following formulation was prepared, and coated onto a sheet of synthetic paper having a thickness of 150 μm by using a wire bar, thereby forming an image receiving layer having a thickness of approximately 5 μm. Thus, an image receiving sheet was prepared.

| | Parts by Weight |
|---|---|
| Polyester resin (Trademark "Vylon 200" made by Toyobo Co., Ltd.) | 10 |
| Silicone oil (Trademark "SF8417" made by Toray Silicone Co., Ltd.) | 1 |
| Toluene | 50 |
| Methyl ethyl ketone | 50 |

The above prepared sublimation type thermosensitive image transfer recording media Nos. 1—1, 1—2 and 1—3 according to the present invention, and the comparative sublimation type thermosensitive image transfer recording media Nos. 1—1, 1—2 and 1—3 were each subjected to a thermal recording test, using a thermal head 6. In this recording test, images were printed repeatedly from an identical spot of each recording medium onto the above-prepared image receiving sheet 3 under the printing conditions of an applied power of 442 mW/dot, and a maximum applied energy of 2.21 mJ/dot. The repetition number of printings was changed from 1 to 7, and the printed image density was measured by Macbeth Densitometer RD-514. Thus, the relationship between the applied thermal energy E (mJ/dot) and the printed image density of each recording medium was investigated. The results are shown in the graphs of FIGS. 2 to 7.

EVALUATION 1—2

After the above multiple printing test, the image receiving layers were each visually observed whether or not the ink layers were abnormally peeled off the support and transferred to the image receiving layer. The results are as follows.

| Recording Medium | Exfoliation of Ink Layer |
|---|---|
| No. 1-1 | not exfoliated |
| No. 1-2 | not exfoliated |
| No. 1-3 | not exfoliated |
| Comp. No. 1-1 | exfoliated |
| Comp. No. 1-2 | exfoliated |
| Comp. No. 1-3 | slightly exfoliated |

Figure 5:
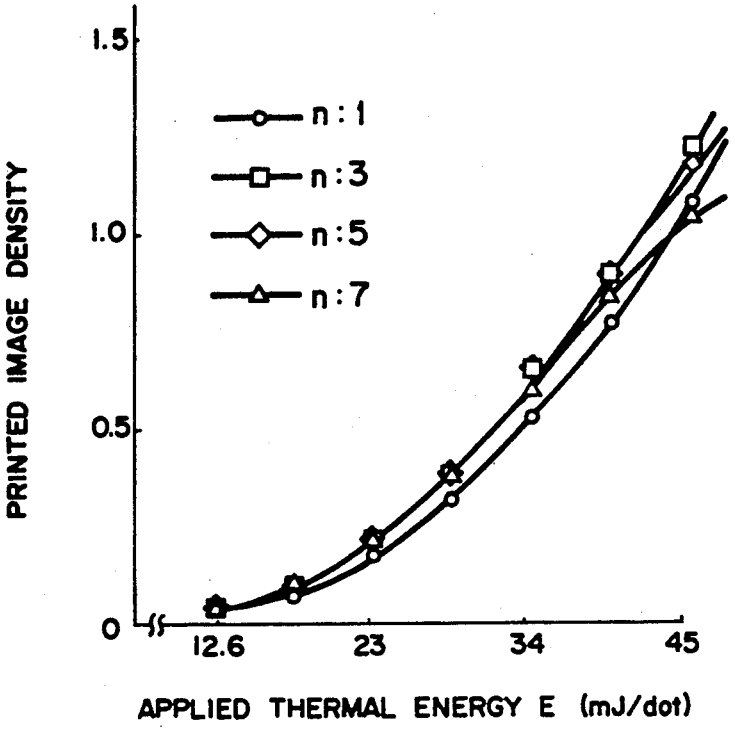
FIG. 5 is a graph showing the relationship between the printed image density (reflected image density) and the applied thermal energy obtained by the comparative sublimation type thermosensitive image transfer recording medium No. 1—1 prepared in Comparative Example 1—1.
Figure 6:
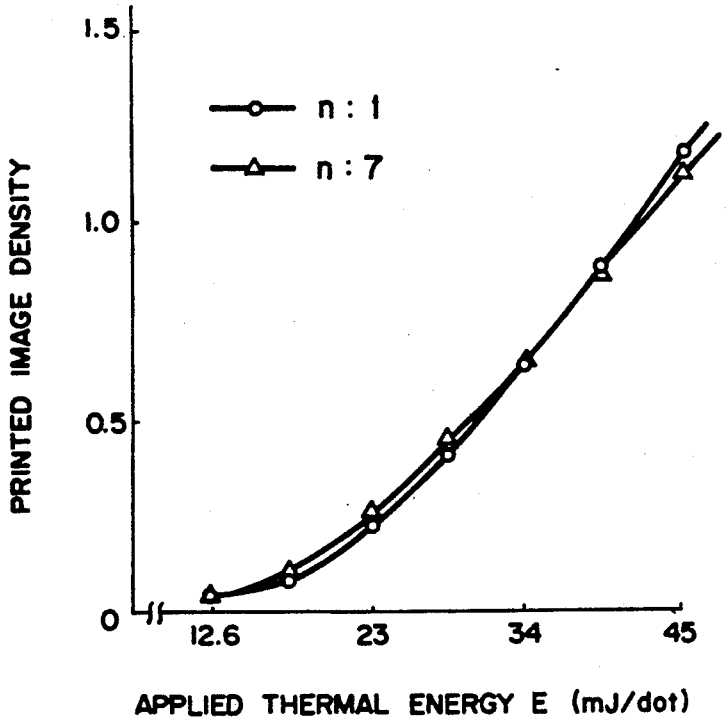
FIG. 6 is a graph showing the relationship between the printed image density (reflected image density) and the applied thermal energy obtained by the comparative sublimation type thermosensitive image transfer recording medium No. 1—2 prepared in Comparative Example 1—2.

As shown in the graph of FIGS. 5 and 6, the comparative sublimation type thermosensitive image transfer recording media Nos. 1—1 and 1—2 can stand for multiple printing. However, they cannot give the printed images of high quality due to abnormal exfoliation of their ink layers.

Figure 7:
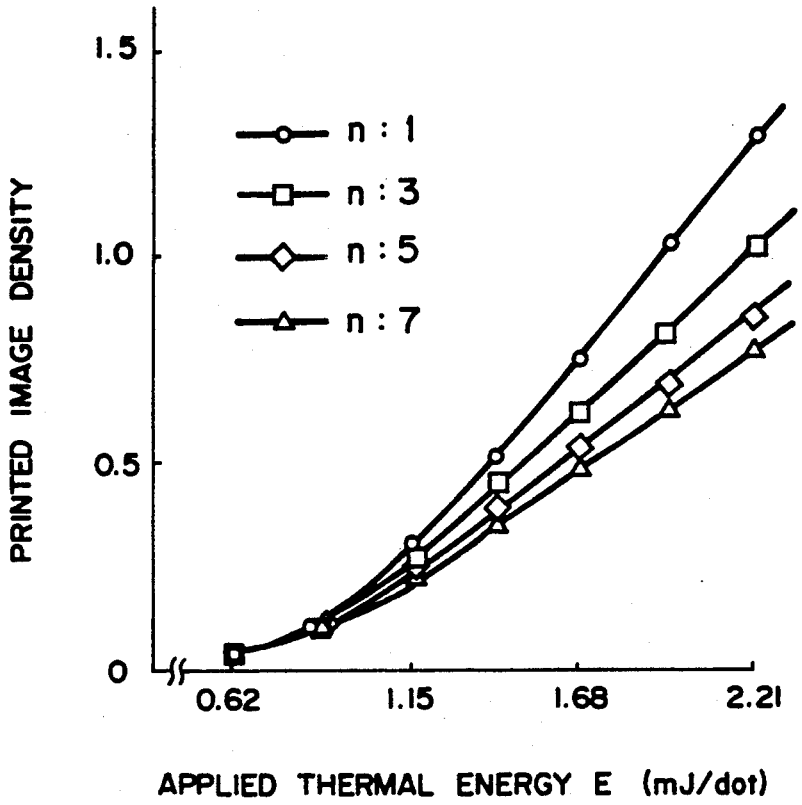
FIG. 7 is a graph showing the relationship between the printed image density (reflected image density) and the applied thermal energy obtained by the comparative sublimation type thermosensitive image transfer recording medium No. 1—3 prepared in Comparative Example 1—3.

The comparative sublimation type tyermosensitive image transfer recording medium No. 1—3 is better than the comparative recording media Nos. 1—1 and 1—2 in terms of abnormal exfoliation of the ink layer. However, it cannot stand for multiple printing as shown in the graph of FIG. 7.

Figure 2:
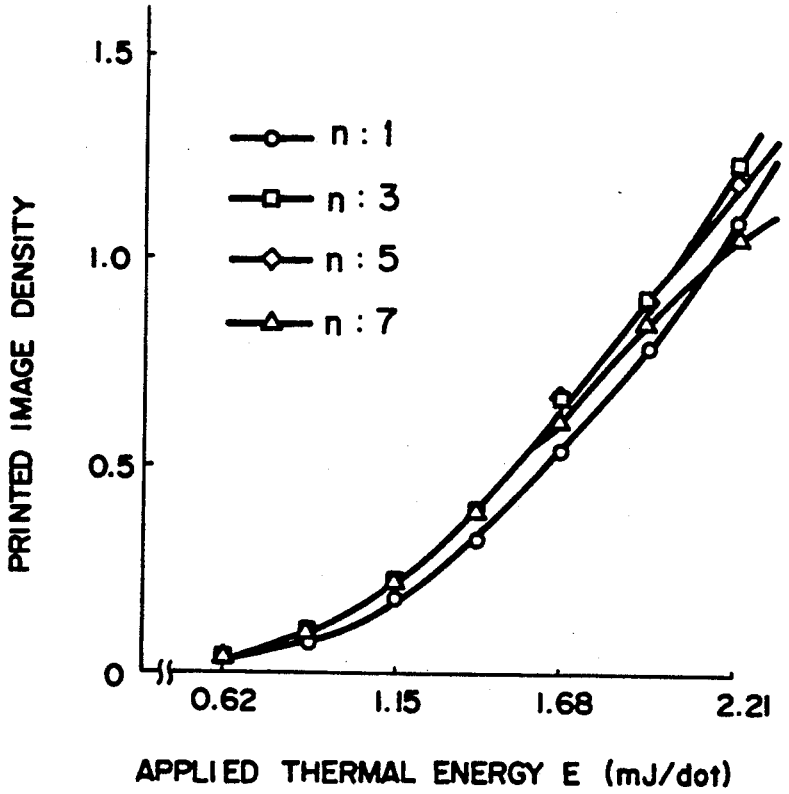
FIG. 2 is a graph showing the relationship between the printed image density (reflected image density) and the applied thermal energy obtained by the sublimation type thermosensitive image transfer recording medium No. 1—1 according to the present invention prepared in Example 1—1.
Figure 3:
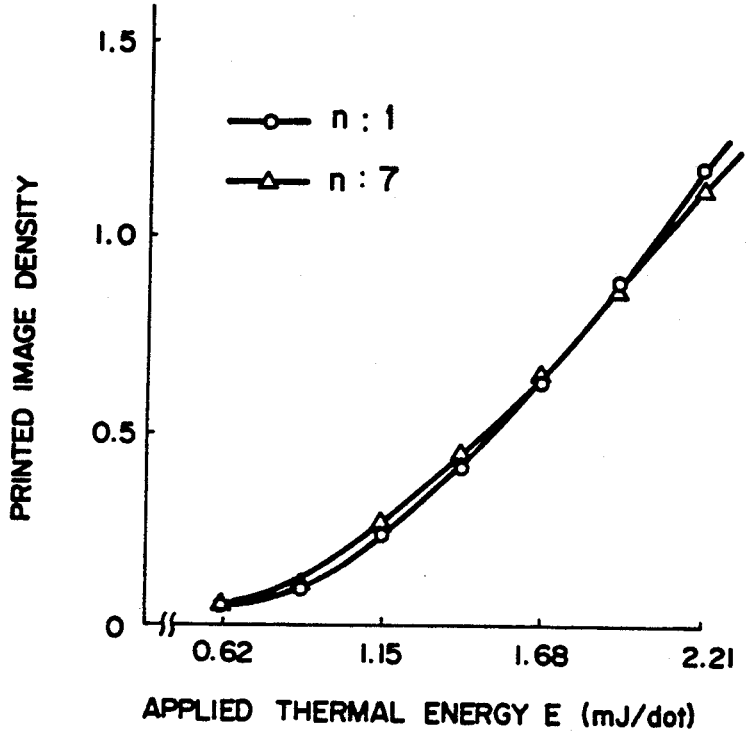
FIG. 3 is a graph showing the relationship between the printed image density (reflected image density) and the applied thermal energy obtained by the sublimation type thermosensitive image transfer recording medium No. 1—2 according to the present invention prepared in Example 1—2.
Figure 4:
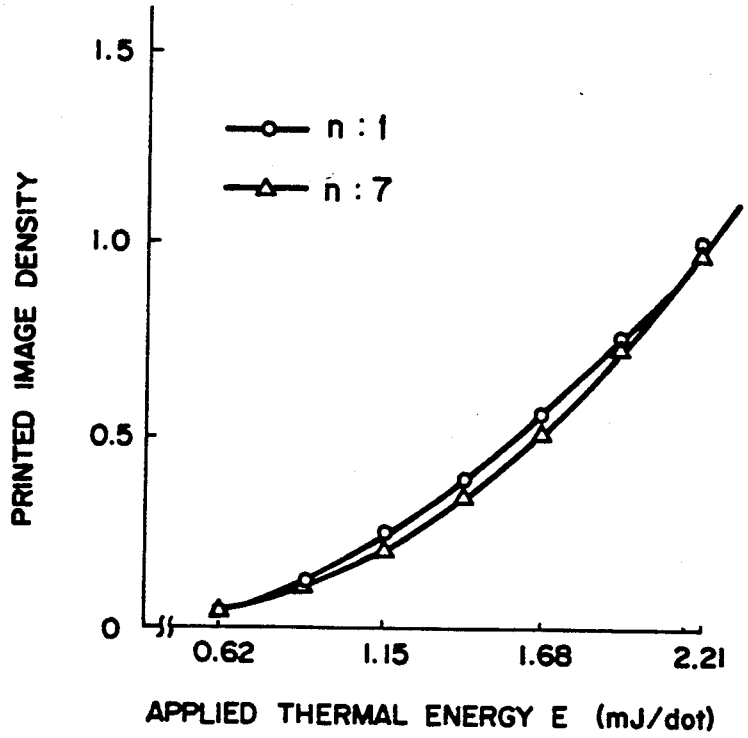
FIG. 4 is a graph showing the relationship between the printed image density (reflected image density) and the applied thermal energy obtained by the sublimation type thermosensitive image transfer recording medium No. 1—3 according to the present invention prepared in Example 1—3.

The sublimation type thermosensitive image transfer recording media Nos. 1—1, 1—2 and 1—3 according to the present invention can well stand for multiple printing as shown in the graphs of FIGS. 2, 3 and 4, and they can also give high quality images without causing exfoliation of their ink layers.

EVALUATION 1—3

The thermosensitive image transfer recording medium No. 1—2 was subjected to the above thermal recording test by changing the ratio of the running speed of the recording medium to that of the recording sheet from 1:1 to 1:15.

As a result, in any running-speed ratios, the printed image density was unchanged for the first 15 times of printing, and no abnormal exfoliation of the ink layer was found. Moreover, no improper running of the recording sheet was caused during the above recording test.

EXAMPLE 2—1

Preparation of Dye Supplying Layer

A mixture of the following components was dispersed in a ball mill for 24 hours, whereby a dye supplying layer coating dispersion No. 2—1 was prepared:

| | Parts by Weight |
|---|---|
| Polyvinyl butyral resin (Trademark "BX-1" made by Sekisui Chemical Co., Ltd.) | 10 |
| Sublimable dye (Trademark "Kayaset Blue 714" made by Nippon Kayaku Co., Ltd.) | 20 |
| Solvents: Toluene | 100 |
| Methyl ethyl ketone | 100 |

Preparation of Image Transfer Facilitating Layer

A mixture of the following components was dispersed in a ball mill for 24 hours, whereby an image transfer facilitating layer coating dispersion No. 2—1 was prepared:

| | Parts by Weight |
|---|---|
| Polyvinyl butyral resin (Trademark "BX-1" made by Sekisui Chemical Co., Ltd.) | 10 |
| Sublimable dye (Trademark "Kayaset Blue 714" made by Nippon Kayaku Co., Ltd.) | 10 |
| Solvents: Toluene | 100 |
| Methyl ethyl ketone | 100 |

Figure 8:
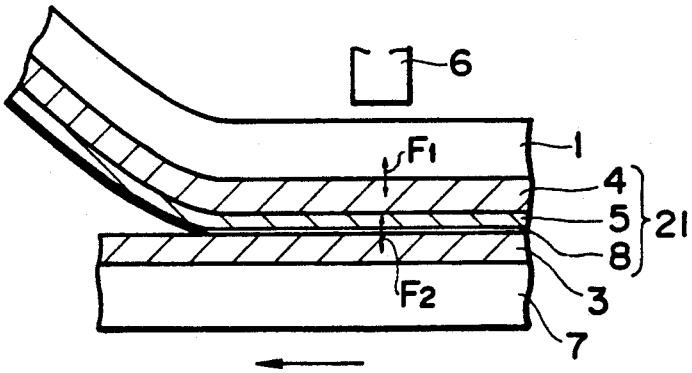
FIG. 8 is a schematic illustration in explanation of the structure of another sublimation type thermosensitive image transfer recording medium according to the present invention.

The dye supplying layer coating dispersion No. 2—1 was coated by a wire bar on a polyimide film having a thickness of 8.5 μm (made by Toray-DuPont Co., Ltd.) serving as a support 1 as illustrated in FIG. 8, whereby a dye supplying layer 4 having a thickness of 2.40 μm when dried was formed on the support 1. Subsequently, the image transfer facilitating layer coating dispersion No. 2—1 was coated by a wire bar on the dye supplying 4 layer and dried, whereby an image transfer facilitating layer 5 having a thickness of 0.61 μm when dried was formed on the dye supplying layer 4.

Thereafter, a dispersion having the following formulation was coated onto the above image transfer facilitating layer 5 with a thickness of 0.5 μm by using a wire bar and dried at 100° C. for 1 minute, thereby providing a releasing thin layer 8. Thus a sublimation type thermosensitive image transfer recording medium No. 2—1 according to the present invention as illustrated in FIG. 8 was prepared.

| | Parts by Weight |
|---|---|
| Silicone resin (Trademark "KS-772" made by Shin-Etsu Chemical Co., Ltd.) | 10 |
| Hardening agent (Trademark "CAT-PL-3") | 0.5 |
| Toluene | 100 |

EXAMPLE 2—2

Example 2—1 was repeated except that the releasing thin layer formed on the image transfer facilitating layer in Example 2—1 was replaced by a releasing thin layer formed as follows:

A dispersion having the following formulation was coated onto the image transfer facilitating layer, by using a wire bar, with a thickness of approximately 0.5 μm, and dried at 100° C. for 1 minute, then at 40° C. for 2 days, thereby providing the releasing thin layer 8 as illustrated in FIG. 8. Thus a sublimation type thermosensitive image transfer recording medium No. 2—2 according to the present invention was prepared.

| | Parts by Weight |
|---|---|
| Polyvinyl butyral resin (Trademark "BX-1" made by Sekisui Chemical Co., Ltd.) | 10 |
| Diisocyanate (Trademark "Takenate D-110N" made by Takeda Chemical Industries, Ltd.) | 1 |
| Silicone oil (Trademark "KF-858" made by Shin-Etsu Chemical Co., Ltd.) | 1 |
| Solvent: Toluene | 95 |
| Methyl ethyl ketone | 95 |

EXAMPLE 2—3

The dye supplying layer and image transfer facilitating layer as in Example 2—1 were formed on the same support as in Example 2—1 in the same manner as in Example 2—1.

A dispersion having the following formulation was coated onto the above-formed image transfer facilitating layer, by using a wire bar, with a thickness of approximately 0.5 μm, and dried at 100° C. for 1 minute, then at 40° C. for 2 days, thereby providing a releasing thin layer 8. Thus a sublimation type thermosensitive image transfer recording medium No. 2—3 according to the present invention was prepared.

| | Parts by Weight |
|---|---|
| Silicone resin solution (Trademark "SD7223" solid content 30%, made by Toray Silicone Co., Ltd.) | 30 |
| Hardening agent (Trademark "SRX-212" made by Toray Silicone Co., Ltd.) | 0.27 |
| Silica | 2.5 |
| Solvent: Toluene | 70 |
| n-Hexane | 30 |

EXAMPLE 2—4

Example 2—1 was repeated except that the releasing thin layer formed on the image transfer facilitating layer in Example 2—1 was replaced by a releasing thin layer formed as follows:

Ultraviolet ray-setting silicone (Trade mark "KNS-5002" made by Shin-Etsu Chemical Co., Ltd.) was coated onto the image transfer facilitating layer, and irradiated for 5 minutes with an ultraviolet ray generated from an ultraviolet ray-hardening device (UV 20 W/cm×8 lights), thereby providing the releasing thin layer having a thickness of 0.3 μm. Thus a sublimation type thermosensitive image transfer recording medium No. 2—4 according to the present invention was prepared.

EXAMPLE 2—5

Example 2—1 was repeated except that the releasing thin layer formed on the image transfer facilitating layer in Example 2—1 was replaced by a releasing thin layer formed as follows:

A dispersion having the following formulation was coated onto the image transfer facilitating layer, by using a wire bar, with a thickness of approximately 0.5 μm, and dried at 80° C. for 1 minute, then at 40° C. for 2 days, thereby providing the releasing thin layer. Thus a sublimation type thermosensitive image transfer recording medium No. 2—5 according to the present invention was prepared.

| | Parts by Weight |
|---|---|
| Silicone-modofied acrylurethane resin solution (Trademark "UA-53F", solid content 44%, made by Sanyo Chemical Industries, Ltd.) | 30 |
| Hardening agent (Trademark "L2-2KO14A" made by Sanyo Chemical Industries, Ltd.) | 1 |
| Solvent: Methyl ethyl ketone | 100 |

EVALUATION 2—1

The above prepared sublimation type thermosensitive image transfer recording media Nos. 2—1, 2—2, 2—3, 2—4 and 2—5 according to the present invention were each subjected to the same thermal recording test as in Evaluation 1—1.

Figure 9:
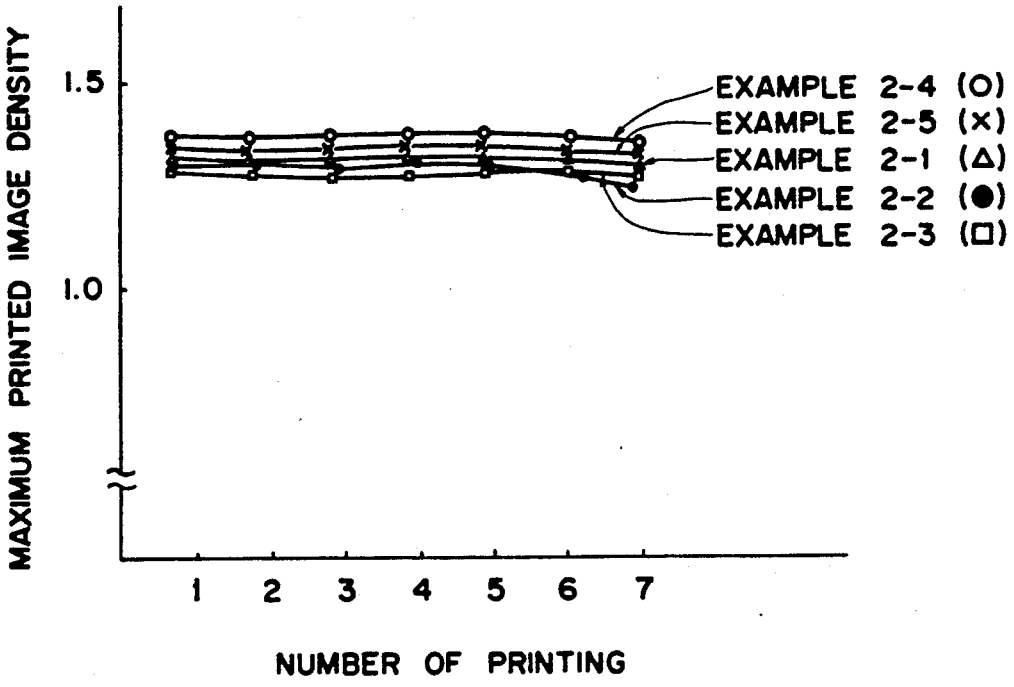
FIG. 9 is a graph showing the relationship between the saturated printed image density and the number of printings obtained by each of sublimation type thermosensitive image transfer recording media Nos. 2—1, 2—2, 2—3, 2—4 and 2—5 according to the present invention prepared in Examples 2—1, 2—2, 2—3, 2—4 and 2—5, respectively.

The results are shown in the graph of FIG. 9, which indicate that there was no substantial difference between the maximum printed densities obtained in the first printing through the 7th printing. Thus the recording media according to the present invention can well stand for the multiple printing.

EVALUATION 2—2

After the above multiple printing test, abnormal exfoliation of each ink layer was confirmed in the same manner as in Evaluation 1—2. As the results, neither exfoliation of the ink layer nor improper running of the recording medium was found.

EXAMPLE 3—1

Figure 10:
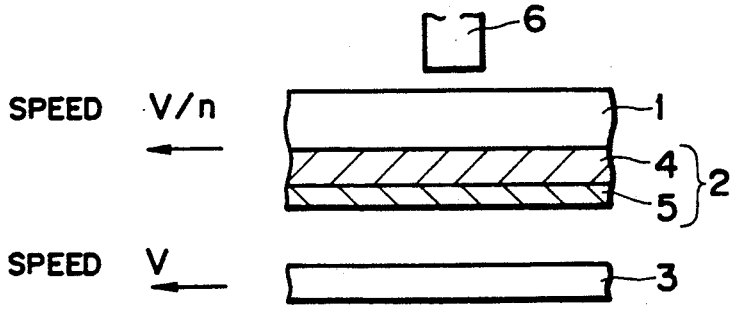
FIG. 10 is a schematic illustration explaining one embodiment of the thermosensitive recording method according to the present invention.
Figure 11:
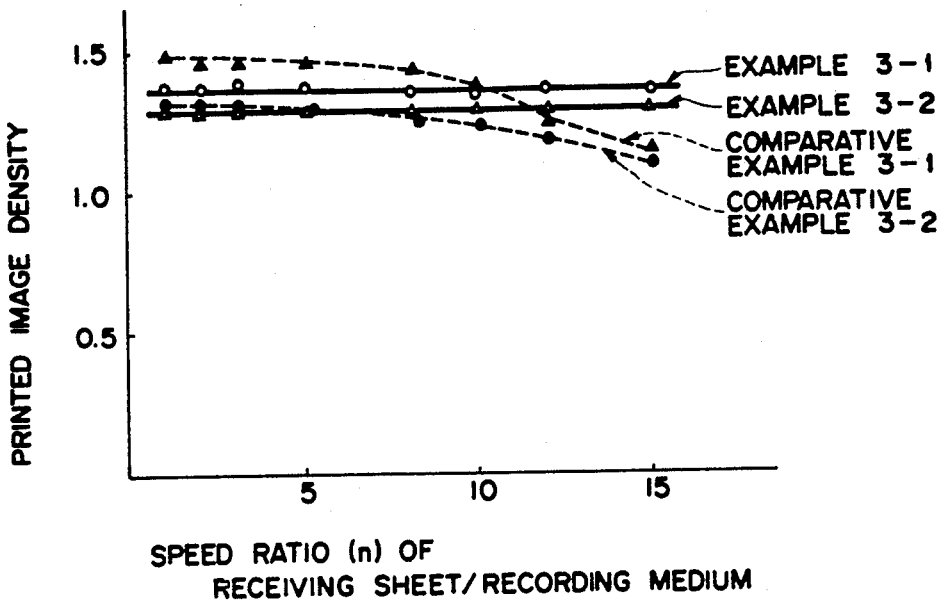
FIG. 11 is a graph showing the relationship between the speed ratio (n) of the image receiving sheet to the thermosensitive image transfer recording medium and the printed image density (reflected image density) obtained in Examples 3—1 and 3—2, and Comparative Examples 3—1 and 3—2.

The sublimation type thermosensitive image transfer recording medium No. 1—1 prepared in Example 1—1 was subjected to a thermal recording, using a thermal head 6, for multiple printing from an identical spot of the recording medium onto a receiving sheet 3, which is commercially available as an image receiving sheet with a trademark of "Supply VY-S100" for Hitachi Video Printer VY-50, with application of a maximum applied energy of 2.21 mJ/dot as illustrated in FIG. 10. In the above, the speed ratio (n) of the receiving sheet to the recording medium was changed from 1 to 15. The printed image density (maximum density) was measured by using a Macbeth Densitometer RD-514. The relationship between the speed ratio n and the maximum image density is shown in FIG. 11.

EXAMPLE 3—2

The sublimation type thermosensitive image transfer recording medium No. 1—2 prepared in Example 2—1 was subjected to the same thermal recording as in Example 3—1. The relationship between (i) the speed ratio (n) of the receiving sheet to the recording medium and (ii) the maximum image density is shown in FIG. 11.

COMPARATIVE EXAMPLE 3—1

The comparative sublimation type thermosensitive image transfer recording medium No. 1—3 prepared in Comparative Example 1—3 was subjected to the same thermal recording as in Example 3—1. The relationship between (i) the speed ratio (n) of the receiving sheet to the recording medium and (ii) the maximum image density is shown in FIG. 11.

COMPARATIVE EXAMPLE 3—2

The ink supply layer coating dispersion No. 1—1 prepared in Example 1—1 was coated onto a polyimide film having a thickness of 8.5 μm (made by Toray-DuPont Co., Ltd.) by using a wire bar, and then dried, thereby forming an ink layer having a thickness of 3.01 μm. Thus, a comparative sublimation type thermosensitive image transfer recording medium 3—2 was prepared.

The above-prepared recording medium was subjected to the same thermal recording as in Example 3—1. The relationship between (i) the speed ratio (n) of the receiving sheet to the recording medium and (ii) the maximum image density is shown in FIG. 11.

The graph in FIG. 11 demonstrates that the printed image densities obtained in Examples 3—1 and 3—2 are almost constant independent of the change in the speed ratio (n) of the receiving sheet to the recording medium. Therefore, the sublimation type thermosensitive recording media Nos. 1—1 and 1—2 according to the present invention can be employed in a multiple printing. On the other hand, the printed image densities obtained in Comparative Examples 3—1 and 3—2 decrease as the speed ratio n increases; the decrease begins around the 5th printing (i.e., n=5).

COMPARATIVE EXAMPLE 3—3

The sublimation type thermosensitive image transfer recording medium No. 1—1 according to the present invention prepared in Example 1—1 was subjected to a thermal recording for multiple printing. In this recording, the speed ratio of the receiving sheet to the recording medium was fixed to 1. The printed image density was measured by using a Macbeth Densitometer RD-514.

Figure 12:
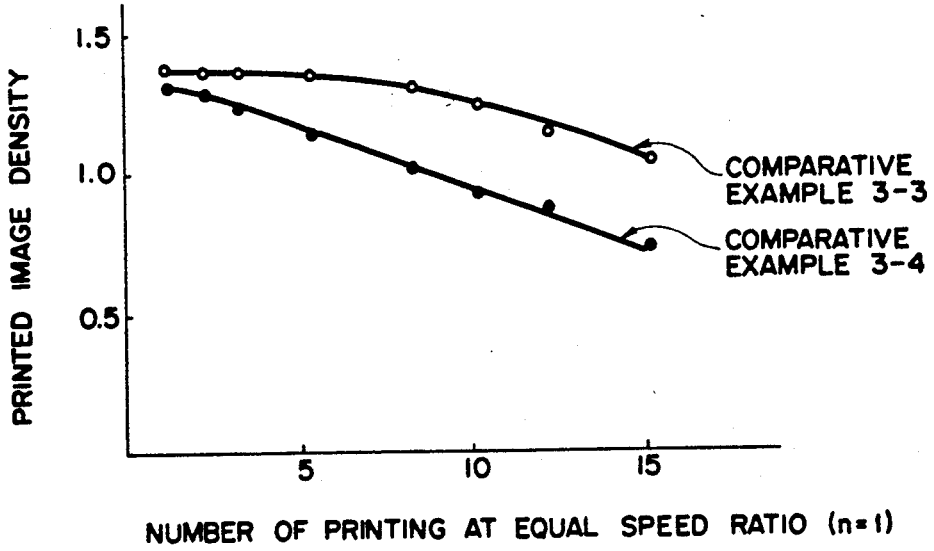
FIG. 12 is a graph showing the relationship between the number of printings at $n=1$ and the printed image density (reflected image density) obtained in Comparative Examples 3—3 and 3—4.

The relationship between the printed image density and the printing number is shown in FIG. 12. As understood from the graph in FIG. 12, the image density began to decrease around the 8th printing (i.e., n=8).

COMPARATIVE EXAMPLE 3—4

The comparative sublimation type thermosensitive image transfer recording medium No. 1—1 prepared in Comparative Example 1—1 was subjected to the same thermal recording as in Comparative Example 3—3.

The relationship between the printed image density an the number of printings is shown in FIG. 12. As understood from the graph in FIG. 12, the image density began to decrease around the 2nd printing (n=2).

As described above, the ink layer of the sublimation type thermosensitive image transfer recording medium according to the present invention is made of two function-separated layers, which are a dye supplying layer and an image transfer facilitating layer. Therefore, the image density printed from the recording medium of the present invention does not lower even when multiple printing is perfomed. Furthermore, the recording medium of the present invention is free from abnormal exfoliation of the ink layer, and never causes improper running of a recording sheet.

What is claimed is:

1. A sublimation type thermosensitive image transfer recording medium comprising:

a support;

a dye supplying layer formed on said support, comprising a sublimable dye and an organic binder agent in which said sublimable dye is dispersed; and an image transfer facilitating layer formed on said dye supplying layer, comprising said sublimable dye, an organic binder agent in which said sublimable dye is dispersed, and a lubricant or releasing material having lubricant or releasing properties, which is dispersed in said image transfer facilitating layer or present on the outer surface of said image transfer facilitating layer.

2. The sublimation type thermosensitive image transfer recording medium as claimed in claim 1, wherein said sublimable dye is selected from the group consisting of disperse dyes and oil-soluble dyes which are volatile or sublimed at 60° C. or more.

3. The sublimation type thermosensitive image transfer recording medium as claimed in claim 1, wherein said organic binder agent is selected from the group consisting of vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-contained resin, butyral resin, melamine resin, natural rubber, synthetic rubber, polyvinyl alcohol, and cellulose resins.

4. The sublimation type thermosensitive image transfer recording medium as claimed in claim 1, wherein the concentration of said sublimable dye contained in said dye supplying layer is 1.1 to 5 times the concentration of said sublimable dye contained in said image transfer facilitating layer.

5. The sublimation type thermosensitive image transfer recording medium as claimed in claim 1, wherein said dye supplying layer further comprises a filler in the form of finely-divided particles.

6. The sublimation type thermosensitive image transfer recording medium as claimed in claim 5, wherein said filler is a metal oxide selected from the group consisting of zinc oxide, tin oxide and aluminum oxide.

7. The sublimation type thermosensitive image transfer recording medium as claimed in claim 5, wherein said filler is a metal selected from the group consisting of aluminum, copper and cobalt.

8. The sublimation type thermosensitive image transfer recording medium as claimed in claim 5, wherein said filler is an organic material selected from the group consisting of diatomaceous earth, Molecular Sieves, phenolic resin, epoxy resin, and carbon black.

9. The sublimation type thermosensitive image transfer recording medium as claimed in claim 5, wherein said filler is a needle-like pigment selected from the group consisting of ochre, Chrome Yellow G, Phthalocyaine Blue, Lithol Red, BON Maroon Light, terra abla, needle zinc oxide, 2,7-bis[2-hydroxy-3-(2-chlorophenylcarbamoyl)-naphthalene-1-ylazo]-9-fluorenone, 4',4''-bis[2-hydroxy-3-(2,4-dimethylphenyl)carbamoylnaphthalene-1-ylazo]-1,4-distyrylbenezene.

10. The sublimation type thermosensitive image transfer recording medium as claimed in claim 1, wherein said lubricant or releasing material is selected from the group consisting of a petroleum lubricating oil, a synthetic lubricating oil, a silicone oil, a silicone lubricating material, a fluorine-containing surface active agent, a fluorine-containing lubricating material, and a wax.

11. The sublimation type thermosensitive image transfer recording medium as claimed in claim 10, wherein said petroleum lubricating oil is liquid paraffin.

12. The sublimation type thermosensitive image transfer recording medium as claimed in claim 10, wherein said synthetic lubricating oil is selected from the group consisting of diester oil, silicone oil and fluorine-containing silicone oil.

13. The sublimation type thermosensitive image transfer recording medium as claimed in claim 10, wherein said silicone oil is selected from the group consisting of epoxy silicone oil, amino silicone oil, alkyl silicone oil and polyether silicone oil.

14. The sublimation type thermosensitive image transfer recording medium as claimed in claim 10, wherein said silicone lubricating material is polyoxyalkylene glycol.

15. The sublimation type thermosensitive image transfer recording medium as claimed in claim 10, wherein said fluorine-containing surface active agent is a fluoroalkyl compound.

16. The sublimation type thermosensitive image transfer recording medium as claimed in claim 10, wherein said fluorine-containing lubricating material is a low-molecular weight polymer of chloroethylene trifluoride.

17. The sublimation type thermosensitive image transfer recording medium as claimed in claim 10, wherein said wax is selected from the group consisting of paraffin wax and polyethylene wax.

18. The sublimation type thermosensitive image transfer recording medium as claimed in claim 1, wherein said lubricant or releasing material is selected from the group consisting of higher fatty acids, higher aliphatic alcohols, higher aliphatic amides, higher aliphatic esters, and salts of higher fatty acids.

19. The sublimation type thermosensitive image transfer recording medium as claimed in claim 1, wherein said lubricant or releasing material is dispersed or dissolved in a heat-resistant resin having a glass transition point of 100° C. or more and a melting or softening point of 200° C. or more.

20. The sublimation type thermosensitive image transfer recording medium as claimed in claim 19, wherein said heat-resistant resistant resin is a thermosetting resin selected from the group consisting of epoxy resin, silicone resin, xylene resin, urea resin, melamine resin, unsaturated polyester resin, alkyd resin and furan resin.

21. The sublimation type thermosensitive image transfer recording medium as claimed in claim 19, wherein said heat-resistant resin is a thermoplastic resin selected from the group consisting of acetylcellulose, acetylbutylcellulose, polysulfone, polycarbonate, polystyrene and acryl resin.

22. The sublimation type thermosensitive image transfer recording medium as claimed in claim 1, wherein said support is made of a resin which is substantially the same as said organic binder agent in said dye supplying layer.

23. The sublimation type thermosensitive image transfer recording medium as claimed in claim 1, wherein said support is backed by a heat-resistant-releasing layer containing as its main component a polysiloxane grafted polymer on the side opposite to said dye supplying layer.

24. A thermosensitive image transfer recording process comprising the steps of:

superimposing the sublimation type thermosensitive image transfer recording medium as claimed in claim 1 on a receiving sheet; and applying heat imagewise to said sublimation type thermosensitive image transfer recording medium so as to imagewise transfer said sublimable dye from said recording medium to said receiving sheet by a heat application recording means as said recording medium and said receiving sheet are moved at an equal speed.

25. A thermosensitive image transfer recording process comprising the steps of:

superimposing the sublimation type thermosensitive image transfer recording medium as claimed in claim 1 on a receiving sheet; and applying heat imagewise to said sublimation type thermosensitive image transfer recording medium so as to imagewise transfer said sublimable dye from said recording medium to said receiving sheet by a heat application recording means as said recording medium and said receiving sheet are moved in such a manner that the running speed of said recording medium is smaller than that of said receiving sheet.

* * * * *

UNITED STATES PATENT AND TRADEMARK OFFICE

CERTIFICATE OF CORRECTION

PATENT NO. : 5,019,550

DATED : May 28, 1991

INVENTOR(S) : Akira Suzuki et al.

It is certified that error appears in the above-identified patent and that said Letters Patent is hereby corrected as shown below:

On the Title page, item (30):

The Foreign Application Priority Data is incorrect, should be,

--Jul. 15, 1988 [JP] Japan .....63-175147

Jul. 15, 1988 [JP] Japan .....63-175148

Aug. 11, 1988 [JP] Japan .....63-201420--.

Signed and Sealed this

Fifteenth Day of December, 1992

*Attest:*

DOUGLAS B. COMER

*Attesting Officer*

*Acting Commissioner of Patents and Trademarks*